US009534280B2

(12) United States Patent
Claude

(10) Patent No.: US 9,534,280 B2
(45) Date of Patent: Jan. 3, 2017

(54) AUSTENITIC IRON-BASED ALLOY, TURBOCHARGER AND COMPONENT MADE THEREOF

(75) Inventor: Antoine Claude, Dommartin-les-Remiremont (FR)

(73) Assignee: BorgWarner Inc., Auburn Hills, MI (US)

( * ) Notice: Subject to any disclaimer, the term of this patent is extended or adjusted under 35 U.S.C. 154(b) by 378 days.

(21) Appl. No.: 14/116,201

(22) PCT Filed: Apr. 30, 2012

(86) PCT No.: PCT/US2012/035759

§ 371 (c)(1), (2), (4) Date: Nov. 7, 2013

(87) PCT Pub. No.: WO2012/158332

PCT Pub. Date: Nov. 22, 2012

(65) Prior Publication Data

US 2014/0086785 A1 Mar. 27, 2014

(30) Foreign Application Priority Data

May 19, 2011 (DE) ..... 10 2011 102 003

(51) Int. Cl.

| | |
|---|---|
| ***C22C 38/22*** | (2006.01) |
| ***C22C 38/26*** | (2006.01) |
| ***C22C 38/38*** | (2006.01) |
| ***C22C 38/58*** | (2006.01) |
| ***C22C 38/00*** | (2006.01) |
| ***C22C 38/02*** | (2006.01) |
| ***B21C 1/00*** | (2006.01) |
| ***C22C 38/04*** | (2006.01) |
| ***C22C 38/08*** | (2006.01) |
| ***C22C 38/12*** | (2006.01) |
| ***C22C 38/44*** | (2006.01) |

(Continued)

(52) U.S. Cl.

CPC ..... *C22C 38/58* (2013.01); *B21C 1/00* (2013.01); *C22C 38/001* (2013.01); *C22C 38/02* (2013.01); *C22C 38/04* (2013.01); *C22C 38/08* (2013.01); *C22C 38/12* (2013.01); *C22C 38/22* (2013.01); *C22C 38/26* (2013.01); *C22C 38/34* (2013.01); *C22C 38/38* (2013.01); *C22C 38/44* (2013.01); *C22C 38/48* (2013.01)

(58) Field of Classification Search

None

See application file for complete search history.

(56) References Cited

U.S. PATENT DOCUMENTS 2,909,425 A * 10/1959 Hsiao et al. ..... C22C 38/38 420/74
3,366,472 A * 1/1968 Tanczyn et al. ..... C22C 38/38 420/74
6,123,748 A 9/2000 Whitaker et al.

(Continued)

FOREIGN PATENT DOCUMENTS

JP WO2008/133320 A1 * 11/2008 ..... C22C 38/58
WO 2010-013083 A1 2/2010

*Primary Examiner* — Deborah Yee

(74) *Attorney, Agent, or Firm* — A. Michael Tucker; Stephan A. Pendorf; Patent Central LLC

(57) ABSTRACT

An austenitic iron-based alloy containing manganese and at most 10% by weight and in particular at most 5% by weight nickel, based in each case on the overall weight of the iron-based alloy.

4 Claims, 1 Drawing Sheet

(51) Int. Cl.
*C22C 38/48* (2006.01)
*C22C 38/34* (2006.01)

(56) References Cited

U.S. PATENT DOCUMENTS

| | | | |
|---|---|---|---|
| 7,682,471 | B2 | 3/2010 | Levin |
| 2010/0012232 | A1 | 1/2010 | John |

* cited by examiner

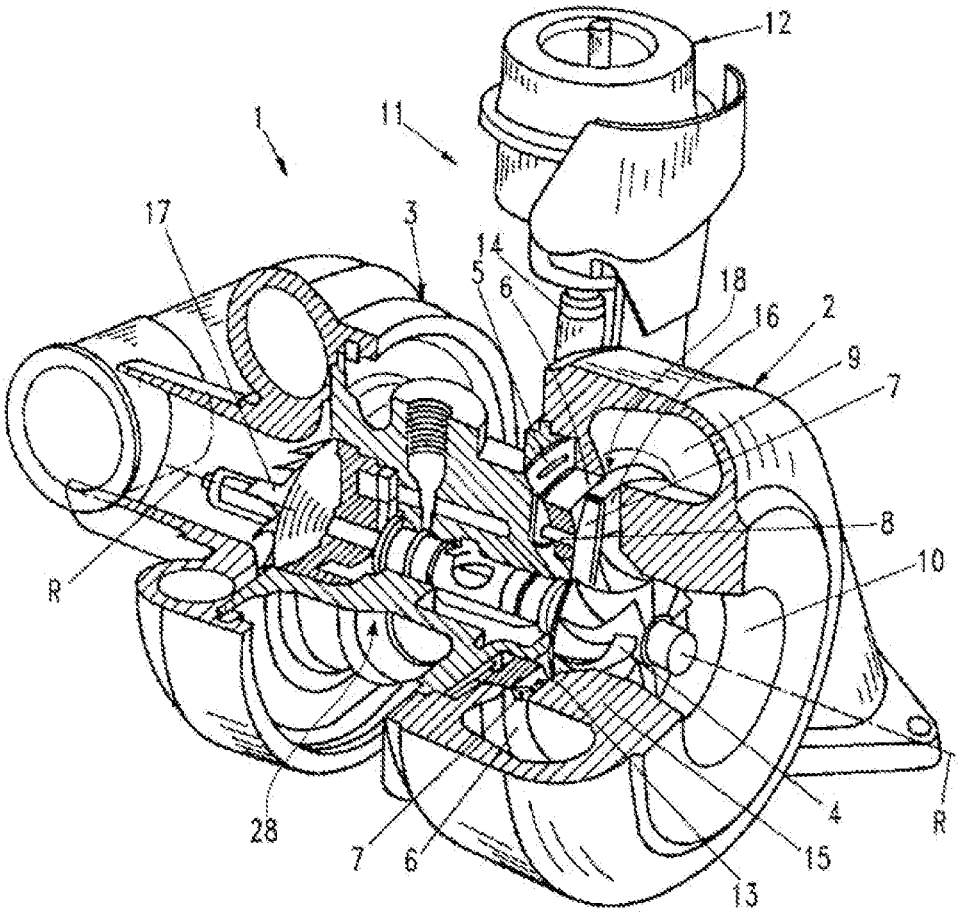
12
1
11
17
3
14
5
6
18
16
2
9
7
8
10
R
28
7
6
4
15
13
R

AUSTENITIC IRON-BASED ALLOY, TURBOCHARGER AND COMPONENT MADE THEREOF

The invention relates to an austenitic iron-based alloy as per the preamble of claim 1, to a component for turbocharger applications which is made of an austenitic iron-based alloy, in particular for diesel or spark-ignition engines having an exhaust-gas temperature of up to 1050° C., and also to an exhaust-gas turbocharger comprising a component.

Exhaust-gas turbochargers are systems intended to increase the power of piston engines. In an exhaust-gas turbocharger, the energy of the exhaust gases is used to increase the power. The increase in power is a result of the increase in the throughput of mixture per working stroke.

A turbocharger consists essentially of an exhaust-gas turbine with a shaft and a compressor, wherein the compressor arranged in the intake tract of the engine is connected to the shaft and the blade wheels located in the casing of the exhaust-gas turbine and the compressor rotate. In the case of a turbocharger having a variable turbine geometry, adjusting blades are additionally mounted rotatably in a blade bearing ring and are moved by means of an adjusting ring arranged in the turbine casing of the turbocharger.

Extremely high demands are made on the material in particular of the components of a turbocharger, and in this case of those components which are exposed to high temperatures or a high degree of friction. The material of these components has to be heat-resistant, i.e. it still has to afford sufficient strength and thus dimensional stability even at very high temperatures of up to about 1050° C. Furthermore, the material has to have a high resistance to wear and good oxidation resistance, so that the corrosion or wear on the material is reduced even at the high operating temperatures of several hundred ° C., and therefore the resistance of the material remains ensured under the extreme operating conditions.

Typical materials which satisfy at least some of these demands are austenitic iron-based alloys having a high nickel content. In this respect, the nickel stabilizes the austenitic structure and makes it possible for such an alloy to have a high thermal stability. The disadvantage here is that the material costs of nickel are very high and furthermore are subject to high fluctuations, which makes detailed cost planning difficult.

Accordingly, it is an object of the present invention to provide an austenitic iron-based alloy as per the preamble of claim 1, a component for turbocharger applications which is made of an austenitic iron-based alloy, and also a turbocharger, which are distinguished by very good temperature and oxidation resistance and therefore also a very good dimensional stability and high high-temperature strength, and also corrosion resistance and a reduced susceptibility to wear and furthermore by relatively low material costs with a small fluctuation in the price for the material.

The embodiment according to the invention, in the form of an austenitic iron-based alloy containing, in addition to iron as the base material, at most 10% by weight and in particular at most 5% by weight nickel, based in each case on the overall weight of the iron-based alloy, and manganese, provides a material which is distinguished by very good physical, chemical and also mechanical properties, and which is therefore suitable, in particular, for producing components which are exposed to high temperatures or high frictional forces. Such components include, in particular, components for motor vehicles, for example exhaust-gas turbocharger applications. Whereas, by contrast, high nickel contents of much more than 20% by weight are common in conventional austenitic iron-based alloys for this type of application (e.g. material number 1.4848 in accordance with EN 10295) in order, in particular, to provide the necessary high temperature resistance of the alloy material and therefore also the dimensional stability thereof at high temperatures, in the iron-based alloy according to the invention the nickel is replaced at least partially by manganese. It has surprisingly been found that the use of manganese as a substitute for nickel in the austenitic iron-based alloys according to the invention likewise leads to a material which is distinguished by outstanding thermal stability and thus dimensional stability at high temperatures, and also high-temperature strength, is resistant to the greatest possible extent to oxidation and also high-temperature oxidation and corrosion and also has a good wear performance. Therefore, the iron-based alloy according to the invention satisfies all requirements of a high-performance material universally for components which are exposed to extreme operating conditions. By substituting nickel with manganese, which stabilizes the austenitic iron-based alloy, the material costs of the iron-based alloy and therefore the costs for producing a component formed therefrom become independent to the greatest possible extent of the high, fluctuating market price of nickel. Even if the nickel content is reduced by about 50%, i.e. given a maximum nickel content of 10% by weight and even better given a nickel content of 5% by weight, based on the overall weight of the iron-based alloy, it is possible to record a considerable reduction in costs for the material, with the material costs being stable to the greatest possible extent over a long period of time and virtually no longer being affected by the fluctuation of the price of nickel. These positive effects are more pronounced, the lower the nickel content in the iron-based alloy. The nickel content in the iron-based alloy according to the invention is therefore preferably 0% by weight, such that, apart from unavoidable impurities, which are estimated to represent a maximum nickel content of less than 1% by weight, based on the overall weight of the iron-based alloy, no nickel is present therein.

The austenitic iron-based alloy according to the invention can be produced by means of conventional processes.

The dependent claims relate to advantageous developments of the invention.

Unless specified otherwise, indications of quantity relate to the overall weight of the iron-based alloy.

According to one embodiment of the present invention, the manganese content is 8 to 25% by weight and in particular 12 to 20% by weight, based on the overall weight of the iron-based alloy. Even above a manganese content of 8% by weight, very good thermal stabilities, i.e. also a high high-temperature strength of the alloy material which comprises at most 10% by weight nickel and preferably at most 5% by weight nickel, based in each case on the overall weight of the iron-based alloy, are achieved. The stabilizing effect which the manganese has on the austenitic iron-based alloy is particularly well pronounced if the manganese content is 12 to 20% by weight and preferably 15 to 17% by weight, based on the overall weight of the iron-based alloy. Within these limits, it is possible to substitute high nickel contents, such that the iron-based alloy can comprise at most 10% by weight nickel, in particular at most 5% by weight nickel and in particular less than 1% by weight nickel, without disadvantageous effects being recorded in relation to the chemical, physical or mechanical properties of the iron-based alloy according to the invention. The manganese content should, however, not exceed preferably 17% by weight, in particular 20% by weight and in particular 25% by weight, based in each case on the overall weight of the iron-based alloy, since very high manganese contents, i.e. in particular more than 25% by weight, lower the hardenability of the alloy material.

In a further embodiment, the austenitic iron-based alloy according to the invention is distinguished by the fact that, in addition to iron and manganese, it contains at least one of the elements selected from the group consisting of: C, Cr, Si, Nb, Mo, W and N. The presence of at least one of these elements is to be understood as meaning that just such an element or a combination of these elements is used for producing the iron-based alloy according to the invention. The elements added to the iron-based alloy can be present therein, or in a component which is formed from said iron-based alloy, in their original form, i.e. in elemental form, for example in the form of inclusions or precipitation phases, or else in the form of derivatives thereof, i.e. in the form of a compound of the corresponding element, e.g. as a metal carbide or metal nitride, which forms either during the production of the iron-based alloy or else when forming the component according to the invention which is produced therefrom. The presence of the respective element can be detected in this case both in the iron-based alloy and in a component produced therefrom easily, by conventional analytical processes.

The element carbon (C) is a gammagenic element and serves primarily for the crystallization of graphite, and therefore for improving the flow properties of the alloy melt. If it is present in an amount of less than 0.05% by weight, based on the overall weight of the iron-based alloy, spherical graphite cannot be crystallized, and therefore the alloy melt has a low flowability. This makes it difficult to produce the iron-based alloy according to the invention. If the carbon content is higher than 0.5% by weight and in particular higher than 1% by weight or even 3% by weight, coarse-grained graphite particles form, these having a negative effect on the room temperature elongation properties of an iron alloy which has been produced by means of pressure die-casting. Furthermore, hollow spaces form during the pressure die-casting as a result of the shrinkage of the material, and these reduce the stability of the iron-based alloy. The carbon content in the iron-based alloy according to the invention is therefore preferably 0.05 to 0.7% by weight, in particular 0.2 to 0.5% by weight and in particular 0.25 to 0.35% by weight, based on the overall weight of the iron-based alloy. As a result, a sufficient flowability of the alloy material is obtained and the austenitic structure of the iron-based alloy according to the invention is sufficiently stabilized.

Nitrogen (N) promotes the stabilizing effect which the manganese has on the austenitic iron-based alloy according to the invention. The combination of manganese and nitrogen is therefore particularly preferable. Nitrogen—like nickel—is a strong gammagenic element which has an advantageous influence on the temperature resistance of the iron-based alloy. A marked effect on the stabilization of the austenitic structure can be identified here even from a nitrogen content of 0.05% by weight and in particular of 0.1% by weight, based on the overall weight of the iron-based alloy. However, only small quantities of nitrogen are soluble in the iron matrix, such that a nitrogen concentration of more than 1% by weight, in particular of more than 2% by weight, based on the overall weight of the iron-based alloy, is reflected by increased shrinkage of the alloy material, and therefore according to the invention the nitrogen content is 0.05 to 2% by weight, in particular 0.1 to 1% by weight and in particular 0.2 to 0.4% by weight.

The element chromium (Cr) in the iron-based alloy according to the invention is a strong carbide former, the carbides of which form precipitation phases in the iron-based alloy, as a result of which the temperature resistance of the material, i.e. the high-temperature strength and high-temperature stability and dimensional stability thereof, are improved. Chromium furthermore has the ability to form a $Cr_2O_3$ surface layer, i.e. an oxidic surface layer on the iron-based alloy or on a component formed therefrom, which efficiently promotes the resistance of the alloy and therefore of the component to oxidation. The element chromium is therefore particularly suitable for ensuring that the iron-based alloy is free from rust. This effect is noticeable even given a chromium concentration of 8% by weight and in particular of 12% by weight, based on the overall weight of the iron-based alloy. In high concentrations of more than 20% by weight and in particular of more than 25% by weight, the element chromium acts as a ferrite stabilizer, i.e. as an alphagenic element, which has a disadvantageous effect on the stability of the austenitic iron-based alloy, or hinders the formation of the austenitic structure, which is essential to the invention, however. According to the invention, the chromium content is therefore preferably in a range of 8 to 25% by weight, in particular 12 to 20% by weight and in particular of 15 to 16.5% by weight, based on the overall weight of the iron-based alloy.

Silicon (Si) is an alphagenic element and promotes the formation of the destabilizing sigma phases. Sigma phases are brittle, intermetallic phases of high hardness. They arise when a body-centered cubic metal and a face-centered cubic metal, whose atomic radii match with only a slight discrepancy, strike one another. Sigma phases of this type are undesirable since they have an embrittling effect and also because of the property of the iron matrix to withdraw chromium. Therefore, the iron-based alloy according to the invention is preferably substantially free of sigma phases, such that the undesirable effects described here fail to appear. The reduction in or prevention of the formation of sigma phases is controlled, in particular, by a targeted selection of the elements of the iron-based alloy, and in particular is achieved in that the silicon content in the alloy material is at most 4.5% by weight and preferably at most 3% by weight, based in each case on the overall weight of the iron-based alloy. According to a further embodiment of the invention, the iron-based alloy according to the invention is substantially free of sigma phases. This applies in particular to the operation of a component made of this iron-based alloy at temperatures of up to 1050° C. This effectively counteracts embrittlement of the material, as a result of which the durability of the component is increased. On the other hand, silicon improves the flowability of the liquid metal alloy, and furthermore forms a passivating oxide layer on the surface of the material which increases the oxidation resistance of the iron-based alloy. According to the invention, the silicon content is therefore preferably in a range of 0.1 to 4.5% by weight, in particular of 0.5 to 3% by weight and in particular of 0.5 to 1.2% by weight, based on the overall weight of the iron-based alloy.

Niobium (Nb) is an alphagenic element and, like silicon, promotes the formation of sigma phases in the austenitic iron-based alloy. The niobium content in the iron-based alloy according to the invention should therefore not exceed 4.5% by weight and preferably 3% by weight, based on the overall weight of the iron-based alloy. On the other hand, niobium is a carbide former, which contributes to stabilization of the austenitic structure of the iron-based alloy according to the invention and in particular to the high-temperature resistance thereof. According to the invention, the niobium content is therefore preferably in a range of 0.1 to 4.5% by weight, in particular of 0.5 to 3% by weight and in particular of 0.5 to 1.2% by weight, based in each case on the overall weight of the iron-based alloy.

Molybdenum (Mo) is an alphagenic element and, like silicon and niobium, promotes the formation of sigma phases in the austenitic iron-based alloy. The molybdenum content in the iron-based alloy according to the invention should therefore not exceed 5% by weight and preferably 3% by weight, based on the overall weight of the iron-based alloy. On the other hand, molybdenum improves the creep resistance of the alloy material at a high temperature. According to the invention, the molybdenum content is therefore preferably at most 5% by weight and in particular at most 3% by weight, based on the overall weight of the iron-based alloy.

Tungsten (W) is likewise an alphagenic element and, like silicon, niobium and molybdenum, promotes the formation of sigma phases in the austenitic iron-based alloy. The tungsten content in the iron-based alloy according to the invention should therefore not exceed 7% by weight and preferably 4% by weight, based on the overall weight of the iron-based alloy. On the other hand, tungsten is a carbide former, which contributes to stabilization of the austenitic structure of the iron-based alloy according to the invention and in particular to the high-temperature resistance thereof According to the invention, the tungsten content is therefore preferably at most 7% by weight and in particular at most 4% by weight, based on the overall weight of the iron-based alloy.

Said elements can be combined with one another as desired, depending on the profile of demands for the iron-based alloy. Furthermore, the iron-based alloy can also comprise further elements which are not presented here.

In a further embodiment, the austenitic iron-based alloy according to the invention is distinguished by the fact that it contains substantially the following elements:

C: 0.05 to 0.7% by weight, in particular 0.2 to 0.5% by weight,
Cr: 8 to 25% by weight, in particular 12 to 20% by weight,
Mn: 8 to 25% by weight, in particular 12 to 20% by weight,
Ni: ≤10% by weight, in particular ≤5% by weight,
Si: 0.1 to 4.5% by weight, in particular 0.5 to 3% by weight,
Nb: 0.1 to 4.5% by weight, in particular 0.5 to 3% by weight,
Mo: ≤5% by weight, in particular ≤3% by weight,
W: ≤7% by weight, in particular ≤4% by weight,
N: 0.05 to 2% by weight, in particular 0.1 to 1% by weight, and
Fe: ad 100% by weight.

The indications of quantity in each case relate here to the overall weight of the iron-based alloy according to the invention. As already stated, the presence of said elements is to be understood as meaning that they can be present both in elemental form and also in the form of one of the compounds thereof in the iron-based alloy, and therefore in a component which is formed from the iron-based alloy according to the invention. In this embodiment, substantially the aforementioned elements are present in the quantities indicated. This means that unavoidable impurities may be present, although these preferably make up less than 2% by weight and in particular less than 1% by weight, based on the overall weight of the iron-based alloy. The quantities of the individual elements can in this case be detected in the iron-based alloy or alternatively also in a component formed therefrom by means of conventional elemental analysis methods.

It has surprisingly been found that precisely the described combination provides a material, i.e. an iron-based alloy, which has a particularly balanced profile of properties. This composition according to the invention provides an alloy material which has a particularly high high-temperature strength, a temperature resistance of up to 1050° C. and therefore dimensional stability and fracture strength at a high temperature, and which is distinguished by an outstanding corrosion resistance and oxidation resistance, in particular at high operating temperatures, as act for example during operation of a turbocharger on a component formed from the iron-based alloy according to the invention, and also by a high flow limit. Such an iron-based alloy is therefore ideally suited for all types of components, in particular in the automotive sector, which are exposed even permanently to high temperatures and also high degrees of friction. Since the nickel content is reduced considerably as compared with conventional austenitic iron-based alloys, the costs of the iron-based alloy are reduced to a steady level and to the greatest possible extent are not subject to any fluctuations, and this makes it possible to assess the costs for producing the iron-based alloy and all components produced therefrom independent of time.

According to a further embodiment, the austenitic iron-based alloy according to the invention is distinguished by the fact that it contains substantially the following elements:

C: 0.25 to 0.35% by weight,
Cr: 15 to 16.5% by weight,
Mn: 15 to 17% by weight,
Si: 0.5 to 1.2% by weight,
Nb: 0.5 to 1.2% by weight,
W: 2 to 3% by weight,
N: 0.2 to 0.4% by weight and Fe, where iron forms the remainder and where the iron-based alloy is substantially free of nickel. In this embodiment, there is substantially no nickel, i.e. no nickel is present except for technically unavoidable impurities. The alloy material is distinguished by outstanding chemical, physical and mechanical properties and, in particular, by excellent temperature resistance, i.e. a high high-temperature strength, a high flow limit and fracture strength at elevated temperatures, and also by a very good oxidation and corrosion resistance. By dispensing with nickel additions, the costs for the alloy material are stabilized permanently at a low level and are subject virtually to no variations or fluctuations. It is thus possible in the long term to also plan the production of components made of the alloy material according to the invention in terms of cost, without it being necessary to correct the costs upward retrospectively. The material is therefore ideally suited for any components which are subject to high demands, in particular with respect to the operating temperatures thereof.

The iron-based alloy according to the invention can be produced by conventional processes, for example by pressure die-casting processes. Similarly, thermal and thermomechanical process technologies from the prior art are suitable for producing the alloy material according to the invention, or for establishing and reinforcing or increasing the strength of the alloy material. Suitable, exemplary processes for producing alloy materials and articles produced therefrom are indicated in the following documents: U.S. Pat. Nos. 4,608,094 A, 4,532,974 A and 4,191,094 A.

According to the invention, what is also described is a component for turbocharger applications, in particular for diesel and spark-ignition engines, in particular a turbine casing, which is formed from the iron-based alloy as described above. As already stated, high demands are made specifically on the quality of the components of a turbocharger, since the latter is operated at high temperatures of up to 1050° C. and in an oxidizing atmosphere. By virtue of the properties described above, the iron-based alloy according to the invention is therefore ideally suited for forming a component for turbocharger applications, and in particular a turbine casing.

What is therefore described is a component for turbocharger applications which has an optimum temperature resistance in the range of up to 1050° C., also has a high high-temperature strength and has a high wear and corrosion resistance and is distinguished in addition by a reduced susceptibility to oxidation, in particular at the high operating temperatures. Furthermore, the component according to the invention, and therefore the exhaust-gas turbocharger according to the invention, is also dimensionally stable and fracture-resistant in permanent operation, and has a high flow limit. Since the nickel content is reduced considerably as compared with conventional components, a stable cost structure of the component at a low level is additionally achieved, this increasing the market acceptance of said component considerably.

The advantageous embodiments of the iron-based alloy according to the invention are also applicable in the embodiments of the component according to the invention for turbocharger applications.

As an object which can be dealt with independently, an exhaust-gas turbocharger comprises at least one component, as already described, which consists essentially of an iron-based alloy containing manganese and at most 10% by weight and in particular at most 5% by weight nickel, based in each case on the overall weight of the iron-based alloy. Such an exhaust-gas turbocharger is distinguished by a very good temperature resistance in the range of up to 1050° C., additionally has a high high-temperature strength and has a high wear and corrosion resistance together with a reduced susceptibility to oxidation. This outstanding profile of properties also qualifies the exhaust-gas turbocharger for permanent operation under extreme ambient conditions. The use of at least one component having a nickel content of at most 10% by weight and in particular of at most 5% by weight, and therefore a nickel content which is reduced considerably as compared with conventional components, additionally achieves a stable cost structure of the turbocharger at a low level, this increasing the market acceptance of said turbocharger considerably.

The advantageous embodiments of the component according to the invention and also of the iron-based alloy according to the invention are also applicable in the embodiments of the exhaust-gas turbocharger according to the invention.

FIG. 1 shows a perspective view, shown partially in section, of an exhaust-gas turbocharger according to the invention. FIG. 1 shows a turbocharger 1 according to the invention, which has a turbine casing 2 and a compressor casing 3 which is connected to the latter via a bearing casing 28. The casings 2, 3 and 28 are arranged along an axis of rotation R. The turbine casing is shown partially in section in order to illustrate the arrangement of a blade bearing ring 6 and a radially outer guide grate 18, which is formed by said ring and has a plurality of adjusting blades 7 which are distributed over the circumference and have rotary axles 8. In this way, nozzle cross sections are formed which, depending on the position of the adjusting blades 7, are larger or smaller and act to a greater or lesser extent upon the turbine rotor 4, positioned in the center on the axis of rotation R, with the exhaust gas from an engine, said exhaust gas being supplied via a supply duct 9 and discharged via a central connection piece 10, in order to drive a compressor rotor 17 seated on the same shaft using the turbine rotor 4.

In order to control the movement or the position of the adjusting blades 7, an actuating device 11 is provided. This may be designed in any desired way, but a preferred embodiment has a control casing 12 which controls the control movement of a tappet member 14 fastened to it, in order to convert the movement of said tappet member on an adjusting ring 5, located behind the blade bearing ring 6, into a slight rotational movement of said adjusting ring. A free space 13 for the adjusting blades 7 is formed between the blade bearing ring 6 and an annular part 15 of the turbine casing 2. So that this free space 13 can be ensured, the blade bearing ring 6 has spacers 16.

EXAMPLE

An iron-based alloy, from which a casing for a turbine of an exhaust-gas turbocharger was produced by a pressure die-casting process, similar to the process outlined in U.S. Pat. No. 4,608,094 A, was formed from the following elements by homogeneous fusion:

C: 0.25 to 0.35% by weight,
Cr: 15 to 16.5% by weight,
Mn: 15 to 17% by weight,
Si: 0.5 to 1.2% by weight,
Nb: 0.5 to 1.2% by weight,
W: 2 to 3% by weight,
N: 0.2 to 0.4% by weight,
remainder: iron.

The iron-based alloy was substantially free of nickel, i.e. the nickel content was less than 1% by weight. The proportion of unavoidable impurities was less than 0.5% by weight.

To determine the temperature and oxidation resistance of the turbine casing, the turbine casing was stored in an oxidizing atmosphere (air) for 24 h at 1050° C. After renewed cooling of the turbine casing, the latter was investigated using a microscope. No indications of deformation or oxidation of the turbine casing were found. Furthermore, a thermal cycle test was carried out for 150 hours at a maximum temperature of 1000° C. This verified that a homogeneous adhesive iron oxide layer having a layer thickness of approximately 80 μm had formed on the surface of the turbine casing.

LIST OF REFERENCE SIGNS

1 Turbocharger
2 Turbine casing
3 Compressor casing
4 Turbine rotor
5 Adjusting ring
6 Blade bearing ring
7 Adjusting blades
8 Pivot axles
9 Supply duct
10 Axial connection piece
11 Actuating device
12 Control casing
13 Free space for guide blades 7
14 Tappet member
15 Annular part of the turbine casing 2
16 Spacer/spacer cam
17 Compressor rotor

18 Guide grate
28 Bearing casing
R Axis of rotation

The invention claimed is:

1. An austenitic iron-based alloy consisting of the following elements:

C: 0.25 to 0.35% by weight,
Cr: 15 to 16.5% by weight,
Mn: 15 to 17% by weight,
Si: 0.5 to 1.2% by weight,
Nb: 0.5 to 1.2% by weight,
W: 2 to 3% by weight,
N: 0.2 to 0.4% by weight,
Fe: to make 100% by weight, with the iron-based alloy being free of nickel.

2. A component for turbocharger applications having an exhaust-gas temperature of up to 1050° C., consisting essentially of an iron-based alloy as claimed in claim 1.

3. An exhaust-gas turbocharger, comprising at least one component consisting of an iron-based alloy as claimed in claim 1.

4. An austenitic iron-based alloy consisting essentially of the following elements:

C: 0.25 to 0.35% by weight,
Cr: 15 to 16.5% by weight,
Mn: 15 to 17% by weight,
Si: 0.5 to 1.2% by weight,
Nb: 0.5 to 1.2% by weight,
W: 2 to 3% by weight,
N: 0.2 to 0.4% by weight,
Fe: to make 100% by weight, with the iron-based alloy being free of nickel except for technically unavoidable impurities.

* * * * *